US006222490B1

(12) United States Patent
Jia-Jiu et al.

(10) Patent No.: US 6,222,490 B1
(45) Date of Patent: Apr. 24, 2001

(54) FISHBONE-SHAPED PATCH ANTENNA

(75) Inventors: Song Jia-Jiu, Taipei; Wu Hung-Chang, Hsinchu, both of (TW)

(73) Assignee: SmartAnt Telecomm Co., Ltd., Hsinchu (TW)

( * ) Notice: Subject to any disclaimer, the term of this patent is extended or adjusted under 35 U.S.C. 154(b) by 0 days.

(21) Appl. No.: 09/542,946

(22) Filed: Apr. 4, 2000

(51) Int. Cl.[7] ..... H01Q 1/36
(52) U.S. Cl. ..... 343/700 MS; 343/834
(58) Field of Search ..... 343/700 MS, 834; H01Q 1/36

(56) References Cited

U.S. PATENT DOCUMENTS 4,903,033 * 2/1990 Tsao et al. ..... 343/700 MS

* cited by examiner

*Primary Examiner*—Michael C. Wimer
(74) *Attorney, Agent, or Firm*—Birch, Stewart, Kolasch & Birch, LLP

(57) ABSTRACT

A fishbone-shaped patch antenna structure is provided to increase half-power beamwidth in the horizontal plane of slot coupled microstrip patch antenna containing limited ground plate and limited reflector. This effect is obtained by designing the resonant member to have a toothed portion along either edge of resonant axis thereof.

15 Claims, 8 Drawing Sheets

FISHBONE-SHAPED PATCH ANTENNA

BACKGROUND OF THE INVENTION

1. Field of Invention

The present invention relates to antenna and more particularly to a fishbone-shaped patch antenna employed in radio communication base station for transmitting signals to mobile terminal and receiving signals from mobile terminal with increased half-power beamwidth in the horizontal plane.

2. Related Art

Mobile phones have become popular in recent years. More people use it as a necessary communication means in daily life. In use, mobile phone has a similar function as wired telephone. That is, mobile phone can effect a two-way communication. Further, each mobile phone has a unique number. Each mobile phone user can make a call to a called party by transmitting encoded signals via base station.

It is understood that most base stations effect a cellular communication principle. That is a high power transmitter for covering all areas is replaced by employing a plurality of low power transmitters in many sectors called cells. As such, many cells are employed to ensure a sufficient communication quality and desired transmitting and receiving ranges. In view of this, transmission power of base station and horizontal and vertical angle ranges of antenna are important factors. It is desired that a cost-effective design may be effected by employing a small number of antennas to obtain a wider transmission and receiving ranges.

A prior art rectangular patch antenna 10 is shown in FIG. 1 comprising a slot coupled microstrip patch antenna 20 made of low loss dielectric plate having a microstrip 21 in rear and a gap or slot 22 in front being connected to signal source (not shown) through a conductor 40; a reflector 30 made of metal plate being non-electrically connected to the rear of slot coupled microstrip patch antenna 20 so as to cause rearward radiated electromagnetic waves to reflect forward; and a resonant member 11 in front of and being non-electrically connected to slot coupled microstrip patch antenna 20 so as to increase directivity, operation band width, an d power of electromagnetic waves.

Signals transmitted by above antenna have a half-power beamwidth with average value of 60°–70° in the center or a maximum value of 80° in the horizontal plane. As such, it is impossible to obtain a wider transmission and receiving ranges by such conventional rectangrular antenna.

SUMMARY OF THE INVENTION

It is therefore an object of the present invention to provide a fishbone-shaped patch antenna employed in radio communication base station serving, as signal transmitting/receiving terminal between base station and a plurality of mobile terminals, thereby increasing half-power beamwidth in the horizontal plane.

The advantages of the present invention are realized by providine a fishbone-shaped patch antenna comprising a slot coupled microstrip patch antenna, a reflector, and a fishbone-shaped resonant member in front of and being non-electrically connected to the slot coupled microstrip patch antenna for increasing half-power beamwidth of electromagnetic waves wherein fishbone-shaped resonant member has a planar elongated shape with a plurality of teeth formed on either of the longer edges. This fishbone-shaped resonant member can increase transmission angle as compared with conventional rectangular resonant member in the base station for obtaining a wider range of transmitting/receiving signals.

Further scope of applicability of the present invention will become apparent from the detailed description given hereinafter. However, it should be understood that the detailed description and specific examples, while indicating preferred embodiments of the invention, arc given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow illustration only, and thus are not limitative of the present invention, and wherein.

DETAILED DESCRIPTION OF THE INVENTION

Figure 1:
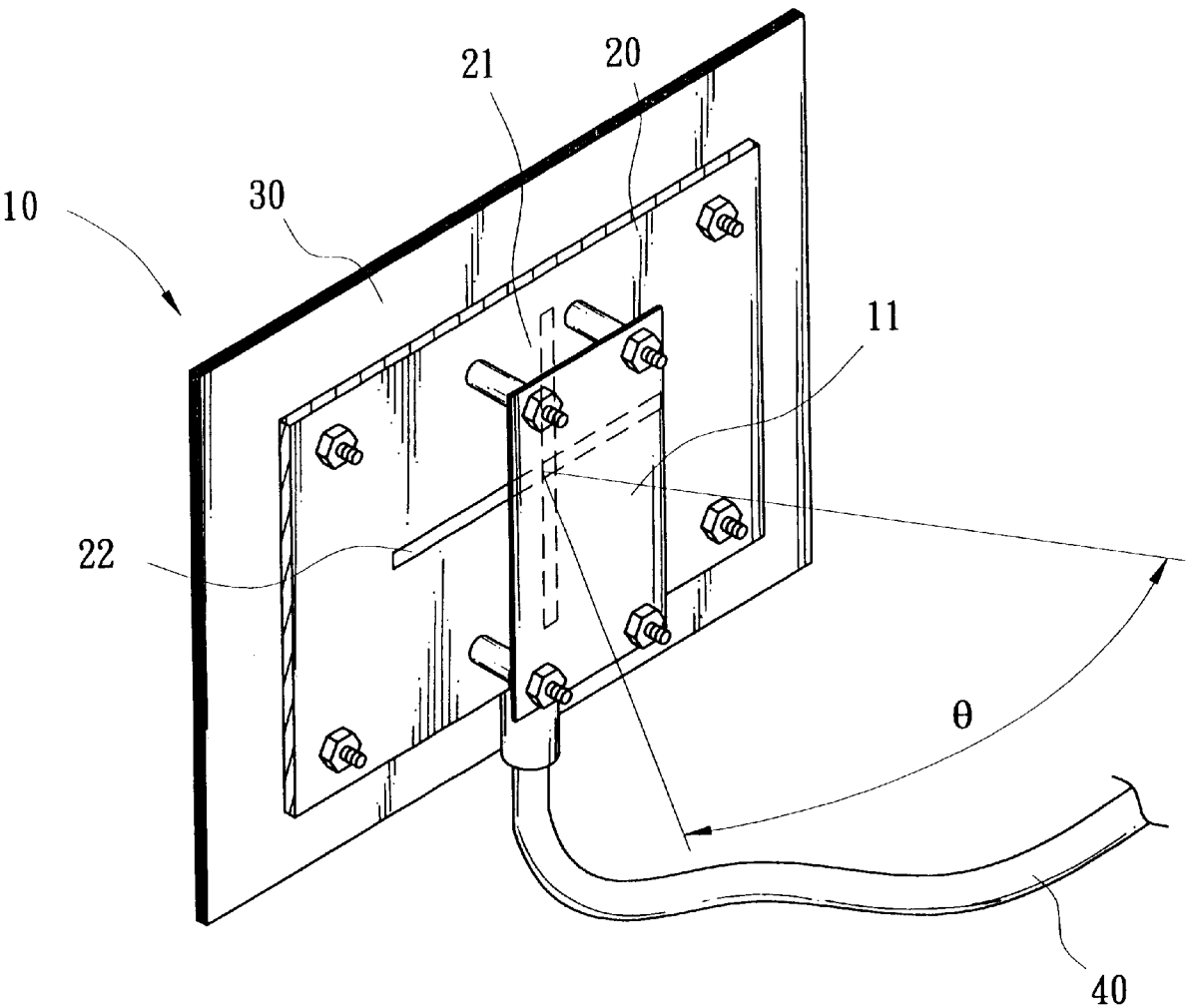
FIG. 1 (PRIOR ART)
FIG. 1 is a perspective view of a conventional rectangular antenna.

Generally speaking, based on applications, a number of parameters are considered in designing a desired patch antenna. These parameters comprises operating frequency, half-power beamwidth in the transmission vertical plane and horizontal plane, voltage standing wave ratio, and antenna gain. An optimal patch antenna is obtained by modifying these parameters. In view of the conventional rectangular antenna shown in FIG. 1, it is found that a reduced width of resonant member 11 has the effect of increasing half-power beamwidth in the horizontal plane. But it is not possible to arbitrarily increase the width of resonant member 11 when considering the factors such as operation bandwidth, return loss, and antenna gain. As such, there is a limit in reducing the width of resonant member 11 for increasing half-power beamwidth in the horizontal plane.

Figure 2:
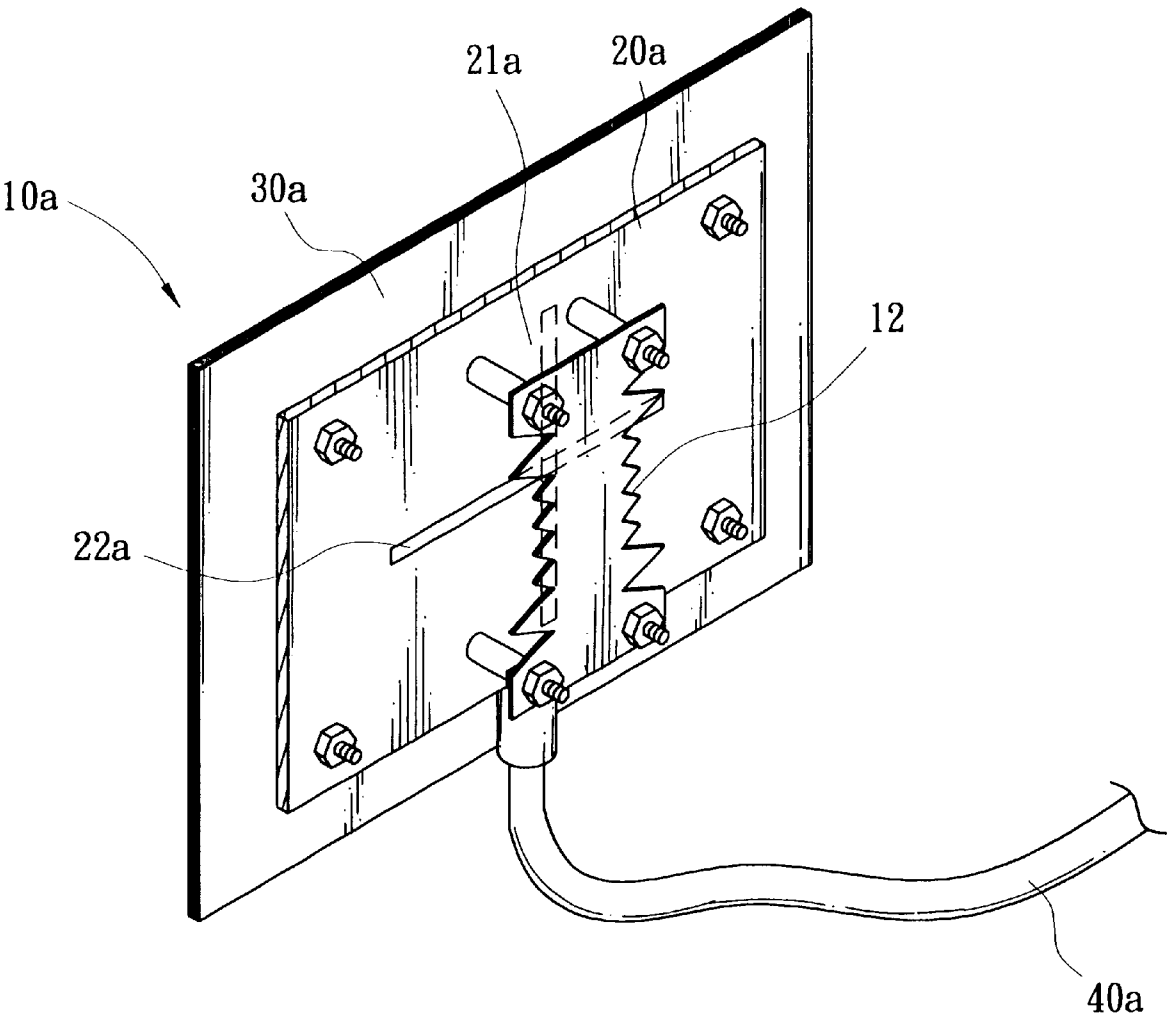
FIG. 2 is a perspective view of a first preferred embodiment of fishbone-shaped patch antenna according to the invention.

Referring to FIG. 2, there is shown a fishbone-shaped patch antenna 10*a* constructed in accordance with the invention comprising a slot coupled microstrip patch antenna 20*a* being in the shape of plate having a microstrip 21*a* in rear, a slot 22*a* in front being connected to signal source (not shown) through a conductor 40*a*; a reflector 30*a* made of metal plate (e.g., aluminium plate. steel plate, or plastic plate with metal film (e.g., copper film) coated) being non-electrically connected to the rear of slot coupled microstrip patch antenna 20*a* so as to cause rearward radiated electromagnetic waves to reflect forward; and a fishbone-shaped resonant member 12 having a planar elongated shape as compared to the rectangular shape of conventional one. Fishbone-shaped resonant member 12 has a plurality of teeth formed on either of the longer sides. Fishbone-shaped resonant member 12 is made of aluminium (Al) or copper (Cu) with good conductivity.

As shown, fishbone-shaped edges parallel to vertical resonant axis of resonant member 12 has the effect of increasing half-power beamwidth by the amount of 5–10. It is important to note that such toothed portion is related to operational frequency in respect of the size of tooth. Further, frequency changes as the tooth density changes. As such, there is no fixed size for toothed portion. Moreover, the distribution of current of resonant member 12 has a concentration in the vicinity of the vertical axis when antenna is operating in the resonant frequency. As such, a significant increase of half-power beamwidth in horizontal plane is obtained when leak current concentrates on the resonant axis. That is the reason why the fishbone-shaped resonant member 12 of the invention has more teeth in the center portion, i.e., in the vicinity of vertical resonant axis of fishbone-shaped resonant member 12.

In addition, there are three types of antennas being formed by combining slot coupled microstrip patch antenna 20*a* and reflector 30*a* as detailed below.

1. Microstrip antenna. It serves as front open circuit of microstrip 21*a*. One side of dielectric substrate of microstrip 21*a* is formed by conductor, while a plurality of feed lines are formed on the other side. Such conductor operates as an unlimited conductor when the width of conductor beneath substrate is larger than that of feed line. Further, a virtual impedance is generated in the microstrip section between the open circuit and the slot for matching with the antenna impedance.

2. Slot antenna. Slot 22*a* is located on resonant member 12. Slot 22*a* has an appropriate length. As such, slot 22*a* can also serve as antenna. An electric field is generated when a high frequency current is applied to the narrow region of slot 22*a* which in turn causes a resonance. As such, slot 22*a* can transfer energy to fishbone-shaped resonant member 12 located above in order to generate a coupling effect. This coupling effect may generate a resonance between resonant member 12 and ground. This resonance phenomenon is employed by the slot-couple stacked microstrip antenna 20*a* of the invention.

3. Antenna with reflector 30*a*. The simplest technique to decrease rearward radiation and cause rearward radiated electromagnetic waves to reflect forward is to mount reflector 30*a* in the rear of antenna. A larger antenna gain or better directivity is obtained if the size of reflector 30*a* is much larger than that of wavelength. It is also found that a certain amount of electromagnetic waves may rearward radiate in reflector 30*a* with limited size. This has an adverse effect to antenna gain.

Signals my be transmitted through fishbone-shaped resonant member 12 after combining above three types of antennas. Moreover, a wider half-power beamwidth in the horizontal plane may be obtained by adjusting the shape of toothed portion and the geometry along the symmetrical edges of resonant axis of fishbone-shaped resonant member 12.

Figure 3A:
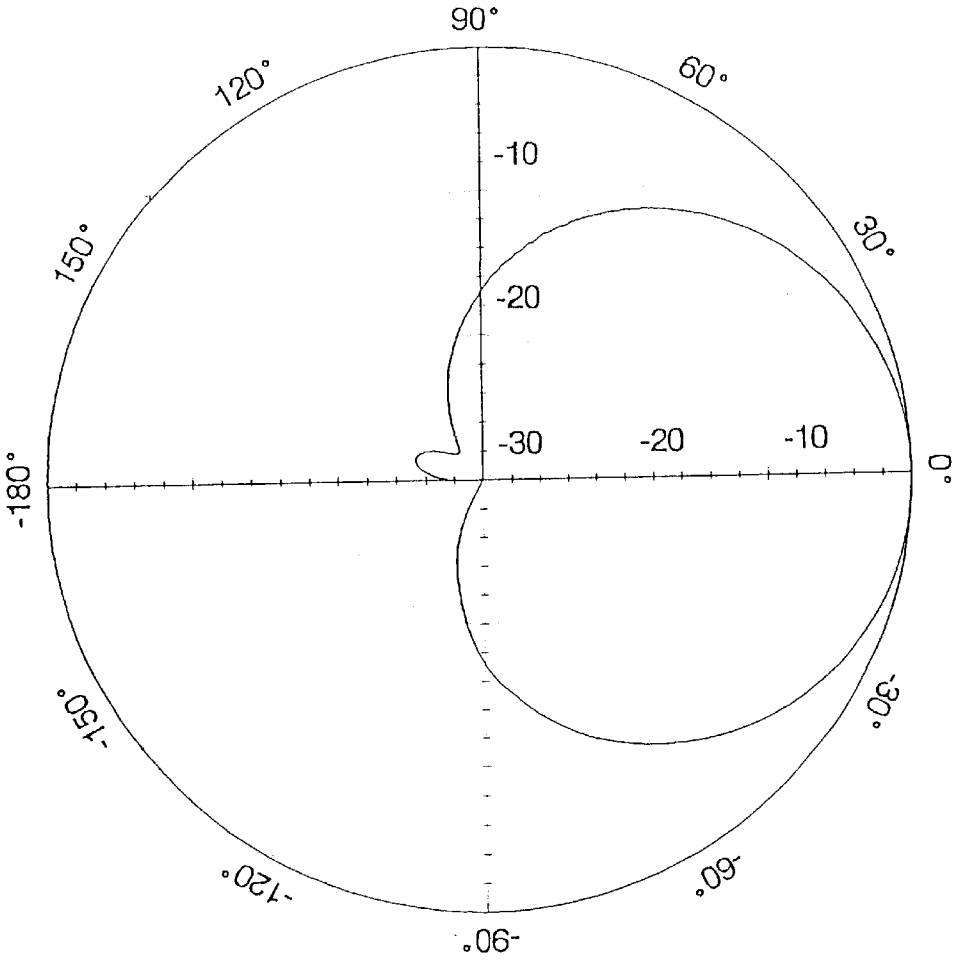
FIGS. 3A–3C are diagrams showing directivities measured in various operating frequencies by the conventional rectangular antenna.
Figure 3B:
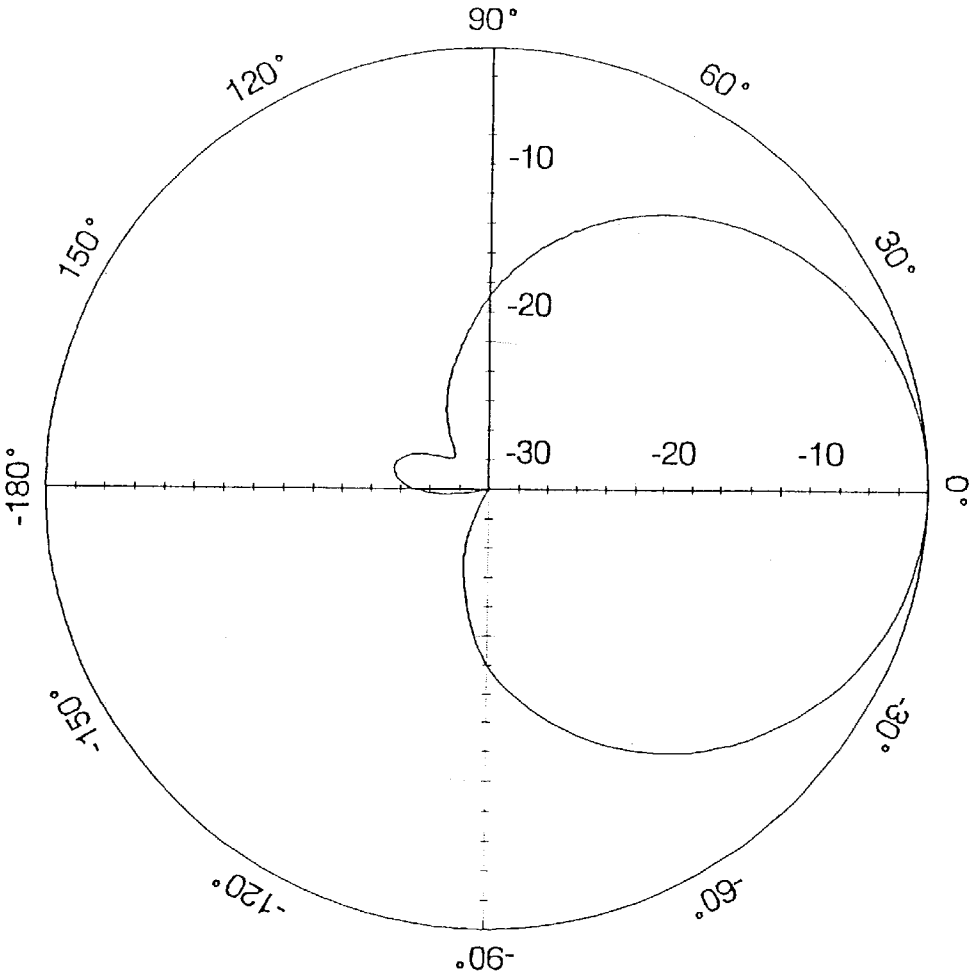
Figure 3C:
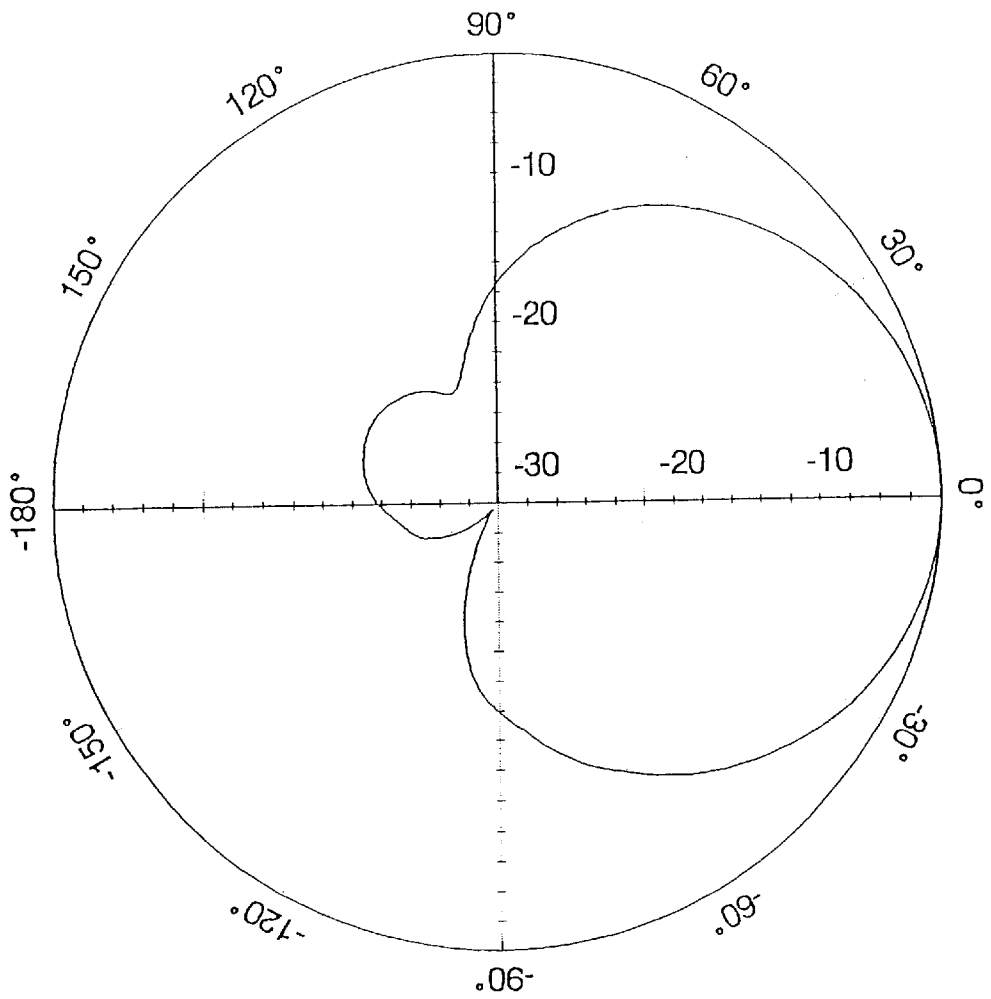

Referring to FIGS. 3A–3C, there is shown directivities measured in various operating frequencies by the conventional rectangular antenna wherein bandwidth is 68° and gain is 11.7 dBi at −3 dB operated in 1,850 MHz in FIG. 3A, bandwidth is 67° and gain is 11.5 dBi at −3 dB operated in 1,920 MHz in FIG. 3B. and bandwidth is 70° and gain is 11.2 dBi at −3 dB operated in 1,990 Mhz in FIG. 3C.

Figure 4A:
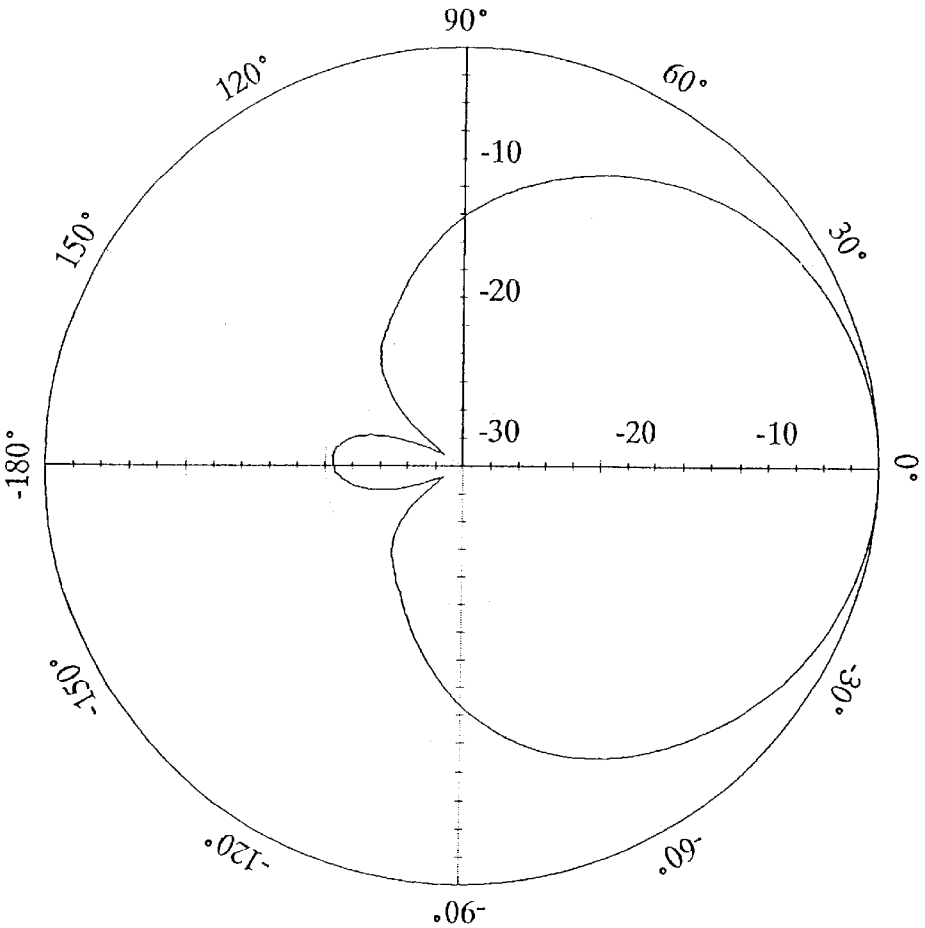
FIGS. 4A–4C are diagrams showing directivities measured in various operating frequencies by the fishbone-shaped patch antenna of the invention.
Figure 4B:
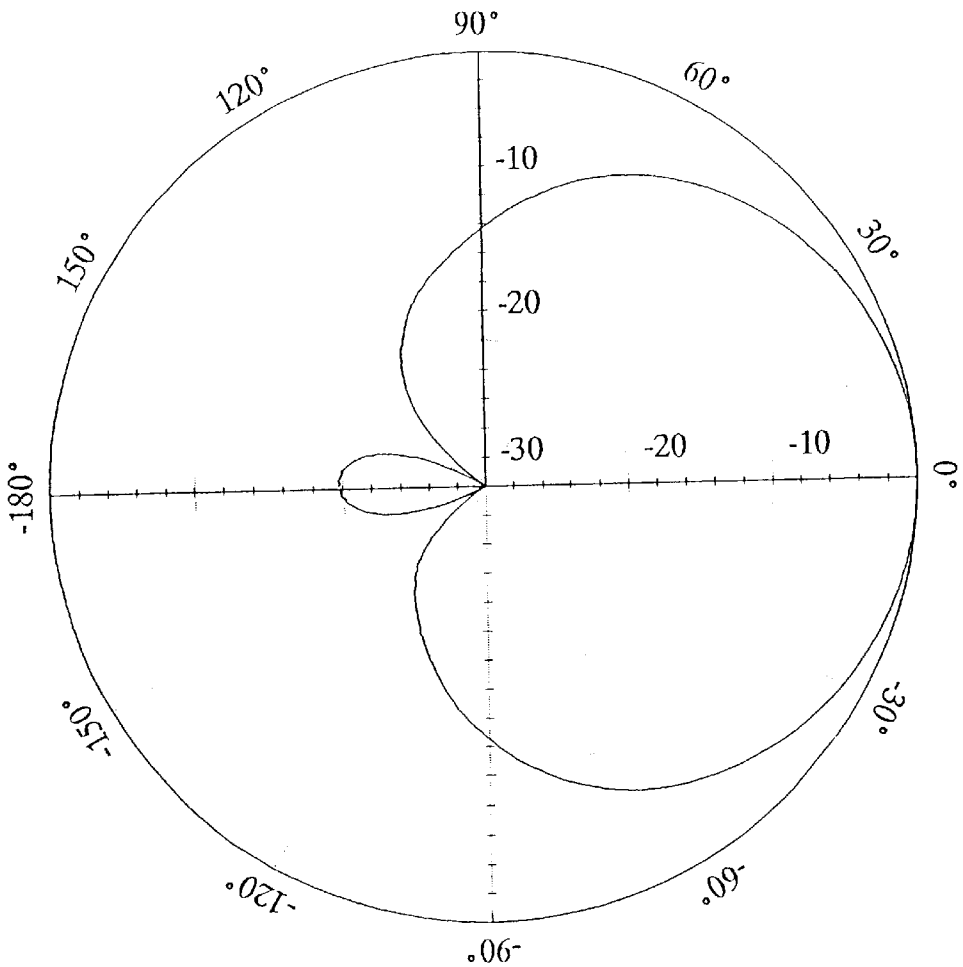
Figure 4C:
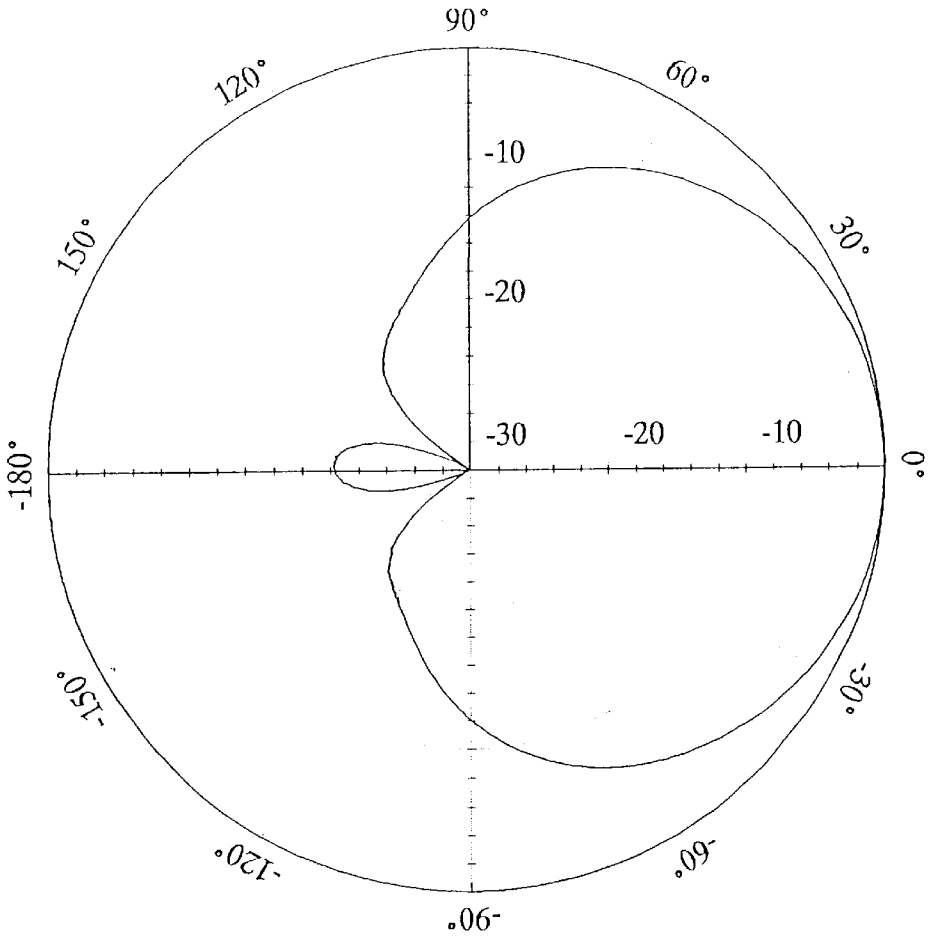

FIGS. 4A–4C illustrate directivities measured in various operating frequencies by the fishbone-shaped patch antenna of the invention wherein bandwidth is 83.9° and gain is 10.2 dBi at −3 dB operated in 1,850 MHz in FIG. 4A, bandwidth is 85.2° and gain is 10 dBi at −3 dB operated in 1,920 MHz in FIG. 4B, and bandwidth is 87.5° and gain is 10.1 dBi at −3 dB operated in 1,990 MHz in FIG. 4C.

In comparison of data obtained by conventional antenna and fishbone-shaped patch antenna of the invention, it is found that bandwidth of the invention is increased about 15° to 18° in respective operational frequency.

This invention provides a fishbone-shaped patch antenna employed in base station for increasing, half-power beamwidth in the horizontal plane, obtaining a wider signal transmitting and receiving angles. Preferably, this invention is implemented as antenna for mobile communication. Most preferably, this invention can be implemented in any of radio communication systems.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A patch antenna mounted in a radio communication base station serving as signal transmitting/receiving terminal between the base station and a plurality of mobile terminals, comprising:

a slot coupled microstrip patch antenna connected to a signal source for transmitting and receiving electromagnetic waves;

a reflector non-electrically connected to and in the rear of the slot coupled microstrip patch antenna for causing rearward transmitted electromagnetic waves to reflect forward; and a resonant member having a planar elongated shape with a plurality of teeth formed on either of the longer edges, the resonant member is in front of and non-electrically connected to the slot coupled microstrip patch antenna for increasing the half-power beamwidth of electromagnetic waves.

2. The patch antenna of claim 1, wherein the reflector has a metal film.

3. The patch antenna of claim 2, wherein the metal film is a copper film.

4. The patch antenna of claim 1, wherein the reflector is a metal plate.

5. The patch antenna of claim 4, wherein the metal plate is an aluminium plate.

6. The patch antenna of claim 4, wherein the metal plate is a steel plate.

7. The patch antenna of claim 1, wherein the distribution of the teeth of the resonant member concentrates in the center thereof so as to increase operational frequency.

8. The patch antenna of claim 1, wherein the valley of each of the teeth in the center has a distance to the vertical center axis of the resonant member shorter than that of the valley of each of the teeth in the distal ends.

9. The patch antenna of claim 1, wherein the resonant member is made of aluminium.

10. The patch antenna of claim 1, wherein the resonant member is made of copper.

11. A resonant device having a planar elongated shape contained in a patch antenna provided in front of and non-electrically connected to a slot coupled microstrip patch antenna in conjunction with a reflector for reflecting electromagnetic waves wherein the resonant device comprises a plurality of teeth formed on either of the longer edges for increasing the half-power beamwidth of electromagnetic waves.

12. The resonant device of claim 11, wherein the distribution of the teeth of the resonant device concentrates in the center thereof so as to increase operational frequency.

13. The resonant device of claim 11, wherein the valley of each of the teeth in the center has a distance to the vertical center axis of the resonant device shorter than that of the valley of each of the teeth in the distal ends.

14. The resonant device of claim 11, wherein the resonant device is made of aluminium.

15. The resonant device of claim 11, wherein the resonant device is made of copper.

* * * * *